US008549664B2

(12) United States Patent
Kahler-Huard

(10) Patent No.: US 8,549,664 B2
(45) Date of Patent: Oct. 8, 2013

(54) WARMING SALON CAPE

(76) Inventor: Elizabeth B Kahler-Huard, Las Vegas, NV (US)

( * ) Notice: Subject to any disclaimer, the term of this patent is extended or adjusted under 35 U.S.C. 154(b) by 282 days.

(21) Appl. No.: 13/113,112

(22) Filed: May 23, 2011

(65) Prior Publication Data

US 2011/0289645 A1 Dec. 1, 2011

Related U.S. Application Data

(60) Provisional application No. 61/348,388, filed on May 26, 2010.

(51) Int. Cl.
*A41D 13/04* (2006.01)

(52) U.S. Cl.
USPC ..... 2/50

(58) Field of Classification Search
USPC ..... 2/50, 88, 48, 85, 93, 94, 49.1–49.5, 51, 2/52, 46, 69, 69.5, 87, 89, 92, 97, 102, 2/104, 114, 207, 247, 272, DIG. 1, 2/DIG. 2; D2/860, 861, 863, 864
See application file for complete search history.

(56) References Cited

U.S. PATENT DOCUMENTS

| | | | | |
|---|---|---|---|---|
| 1,467,718 | A * | 9/1923 | Entrikin et al. | 2/88 |
| 3,018,486 | A * | 1/1962 | Bukspan | 2/87 |
| 3,031,676 | A * | 5/1962 | Larson | 2/50 |
| 3,514,788 | A * | 6/1970 | Miller | 2/87 |
| 3,665,518 | A * | 5/1972 | Leadford | 2/88 |
| 3,781,916 | A * | 1/1974 | Vitol | 2/88 |
| 4,118,802 | A * | 10/1978 | Polster | 2/84 |
| 4,458,364 | A * | 7/1984 | Fenninger et al. | 2/50 |
| 6,185,743 | B1 * | 2/2001 | Mick | 2/84 |
| 6,868,554 | B1 * | 3/2005 | Melvin | 2/50 |
| 6,966,069 | B2 * | 11/2005 | Booth | 2/69 |
| 7,444,684 | B1 * | 11/2008 | Medina | 2/48 |
| 8,161,572 | B1 * | 4/2012 | Rorke | 2/50 |
| 2003/0088902 | A1 * | 5/2003 | Levy | 2/50 |
| 2009/0300815 | A1 * | 12/2009 | Nunez | 2/50 |

* cited by examiner

*Primary Examiner* — Amy Vanatta
(74) *Attorney, Agent, or Firm* — Michael Ries

(57) ABSTRACT

The present invention is a warming salon cape with a front planar facing and a rear planar facing, a bias binding, a pouch that is utilized to hold one or more objects, an exterior covering, a label and a plurality of fabric piping. The warming salon cape also includes one or more fasteners, a neck aperture that is formed when the fasteners are releasably engaged securing the warming salon cape around the user, a plurality of sewn threading and a plurality of vents. The present invention also includes a method for using a warming salon cape that includes the steps of asking a client being groomed their ability to self-regulate their body temperature, providing the warming salon cape to the client and having the client wear the warming salon cape.

17 Claims, 3 Drawing Sheets

WARMING SALON CAPE

This application claims priority to U.S. Provisional Application 61/348,388 filed on May 26, 2010, the entire disclosure of which is incorporated by reference.

TECHNICAL FIELD & BACKGROUND

Hair salon clients can sometimes get cold while having their hair done or other grooming performed.

It is an object of the present invention to provide a warming salon cape that provides warmth and comfort to a user's while the user is being groomed.

It is an object of the present invention to provide a warming salon cape that can be conveniently utilized by a user while the user is being groomed.

It is an object of the present invention to provide a warming salon cape that helps a user self-regulate their body temperature while being groomed.

What is really needed is a warming salon cape that provides warmth and comfort to a user while the user is being groomed that can be conveniently utilized by a user while the user is being groomed and that helps a user self-regulate their body temperature while being groomed.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
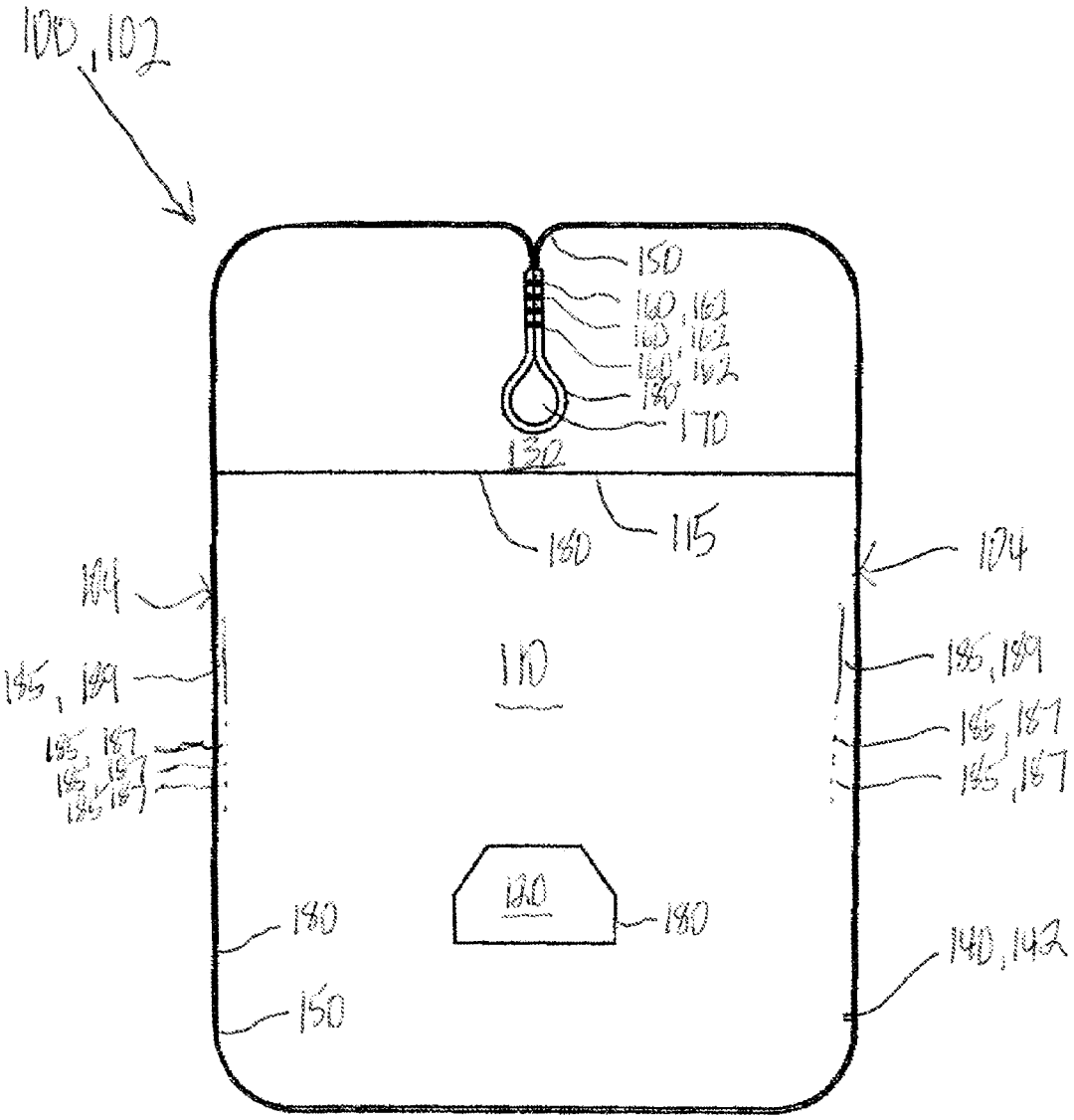
FIG. 1A illustrates a front perspective view of a warming salon cape, in accordance with one embodiment of the present invention.

FIG. 1A illustrates a front perspective view of a warming salon cape 100, in accordance with one embodiment of the present invention. The warming salon cape 100 includes a front planar facing 110, a bias binding 115, a pouch 120, an exterior covering 130, a label 140, a plurality of fabric piping 150, one or more fasteners 160, a neck aperture 170, a plurality of threading 180 and a plurality of vents 185. The warming salon cape 100 has a generally rectangular shape 102, although the warming salon cape 100 can have any suitable shape such as a circular shape or a triangular shape. The warming salon cape 100 covers the front of a user (not shown) being groomed in a salon, a barber shop or other grooming venue.

The front planar facing 110 is made of planar sheet-like material such as cloth or other suitable material. The bias binding 115 is defined as a decorative finish of varying width that encases an edge. The pouch 120 is disposed on the front planar facing 110 of the warming salon cape 100 and can be utilized to hold any suitable objects such as a plurality of coins or paper money, a plurality of keys or a cell phone. The exterior covering 130 is disposed on the entire front planar facing 110 of the warming salon cape 100 and can be made of nylon, vinyl, cotton or cotton blend material. The label 140 can be a salon related label 142 or other suitable label disposed anywhere on the front planar facing 110. The fabric piping 150 is defined as a relatively small roll of fabric, sewn-on to hems, sleeves and/or collar edges of the warming salon cape 100 disposed anywhere on the front planar facing 110. Fasteners 160 include one or more snaps 162, although the fasteners 160 can also include one or more clips, buttons, ties or other suitable fasteners disposed on the front planar facing 110. The neck aperture 170 is formed when the fasteners 160 are releasably engaged securing the warming salon cape 100 to the front of the user. The threading 180 is sewn threading that can be functional to secure pieces together or decorative. The vents 185 are disposed on the sides 104 of the warming salon cape 100 and can be a plurality of apertures 187, a plurality of slits 189 or a combination of both. The vents 185 allow for heat escape while the user is wearing the warming salon cape 100 for added comfort.

Figure 1B:
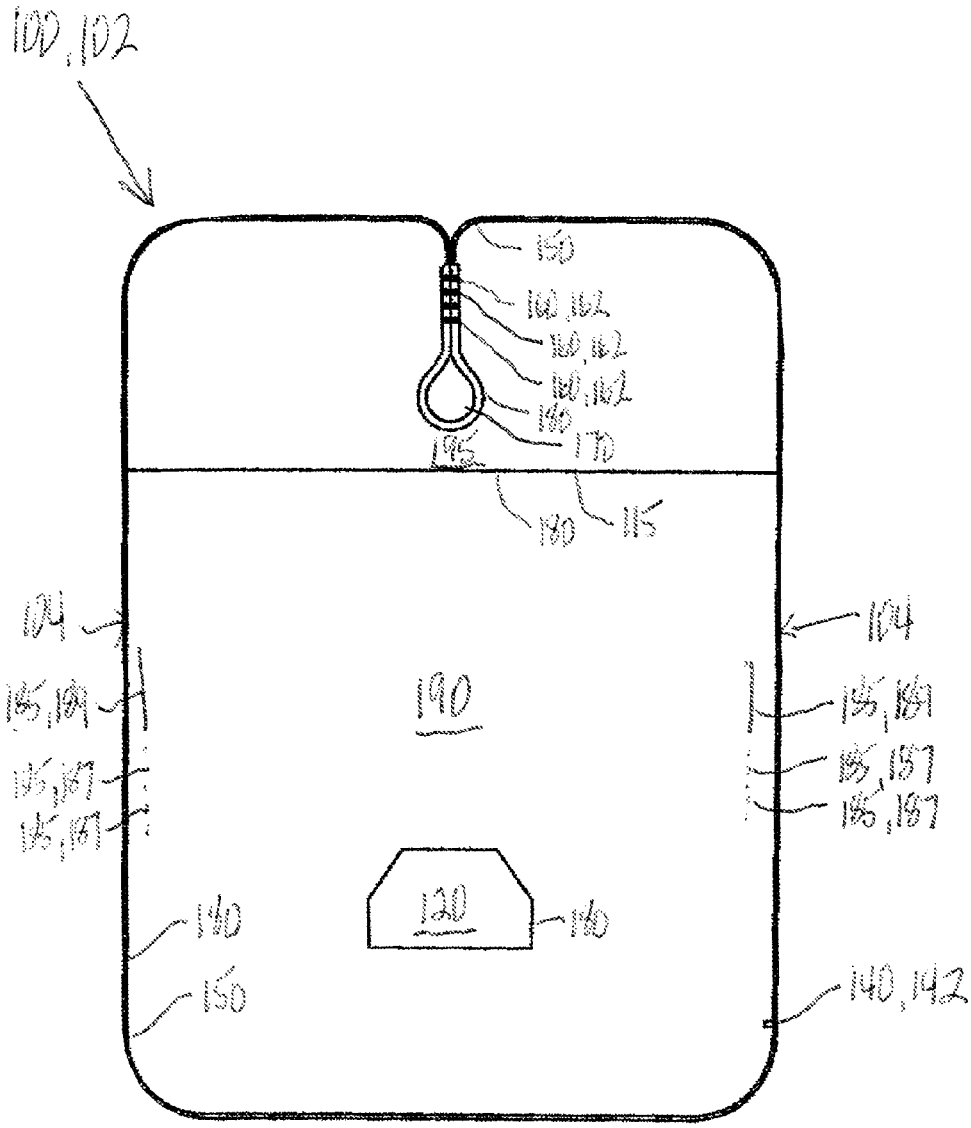
FIG. 1B illustrates a rear perspective view of a warming salon cape, in accordance with one embodiment of the present invention.

FIG. 1B illustrates a rear perspective view of a warming salon cape 100, in accordance with one embodiment of the present invention. The warming salon cape 100 includes a rear planar facing 190, a bias binding 115, a pouch 120, a label 140, a plurality of fabric piping 150, one or more fasteners 160, a neck aperture 170 and a plurality of threading 180. The warming salon cape 100 has a generally rectangular shape 102, although the warming salon cape 100 can have any suitable shape such as a circular shape or a triangular shape. The warming salon cape 100 covers the front of a user being groomed in a salon, a barber shop or other grooming venue. All of the features of the front planar facing 110 described in FIG. 1A are similar to the rear planar facing 190 described in FIG. 1B, except the interior liner 195 replaces the exterior covering 130 found in FIG. 1A.

Figure 2:
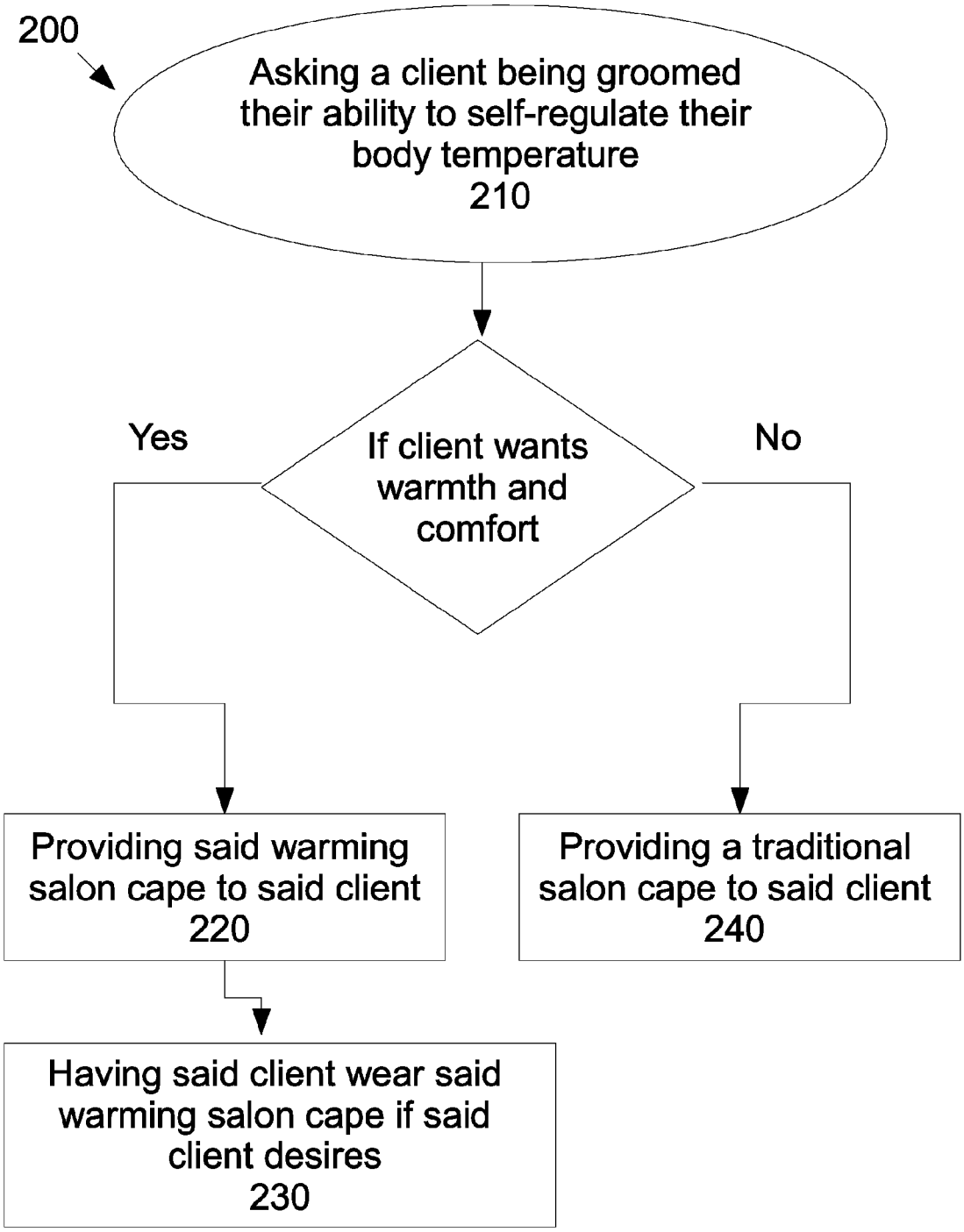
FIG. 2 illustrates a flow chart of a method for using a warming salon cape, in accordance with one embodiment of the present invention.

FIG. 2 illustrates a flow chart of a method 200 of using a warming salon cape, in accordance with one embodiment of the present invention. The overall method 200 includes the steps of asking a client being groomed their ability to self-regulate their body temperature 210, providing the warming salon cape to the client 220 and having the client wear the warming salon cape if the client desires 230. Asking a client being groomed their ability to self-regulate their body temperature 210 includes if the client would like assistance in maintaining warmth and comfort, then the providing the warming salon cape to the client 220 step is performed. If the client would not like assistance in maintaining warmth and comfort, then the providing a traditional salon cape to the client 240 step is performed. The traditional salon cape does not have the warming and comfort features that the warming salon cape has, as previously described in FIGS. 1A and 1B.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A warming salon cape with two sides worn by a user being groomed, comprising:

a front planar facing and a rear planar facing;

a pouch disposed on said front planar facing and said rear planar facing that is utilized to hold one or more objects;

an exterior covering disposed on said front planar facing;

an interior liner disposed on said rear planar facing;

a label disposed on said front planar facing and said rear planar facing;

one or more fasteners disposed on said front planar facing and rear planar facing;

a neck aperture that is formed when said fasteners are releasably engaged securing said warming salon cape around said user;

a plurality of sewn threading disposed on said front planar facing and said rear planar facing; and a plurality of vents disposed on said sides of warming salon cape.

2. The cape according to claim 1, wherein said objects are one or more coins or paper money.

3. The cape according to claim 1, wherein said objects are one or more keys.

4. The cape according to claim 1, wherein said object is a cell phone.

5. The cape according to claim 1, wherein said label is a salon related label.

6. The cape according to claim 1, wherein said exterior covering is selected from the group consisting of nylon, vinyl, cotton or cotton blend material.

7. The cape according to claim 1, wherein said fasteners include one or more snaps.

8. The cape according to claim 1, wherein said vents include a plurality of apertures, a plurality of slits or a combination of said apertures and slits.

9. A warming salon cape with two sides worn by a user being groomed, comprising:

a front planar facing and a rear planar facing;

a bias binding disposed on said front planar facing and said rear planar facing;

a pouch disposed on said front planar facing and said rear planar facing that is utilized to hold one or more objects;

an exterior covering disposed on said front planar facing;

an interior liner disposed on said rear planar facing;

a label disposed on said front planar facing and said rear planar facing;

a plurality of fabric piping disposed on said front planar facing and said rear planar facing;

one or more fasteners disposed on said front planar facing and said rear planar facing;

a neck aperture that is formed when said fasteners are releasably engaged securing said warming salon cape around said user;

a plurality of sewn threading disposed on said front planar facing and said rear planar facing; and a plurality of vents disposed on said sides of warming salon cape.

10. The cape according to claim 9, wherein said objects are one or more coins or paper money.

11. The cape according to claim 9, wherein said objects are one or more keys.

12. The cape according to claim 9, wherein said object is a cell phone.

13. The cape according to claim 9, wherein said label is a salon related label.

14. The cape according to claim 9, wherein said exterior covering is selected from the group consisting of nylon, vinyl, cotton or cotton blend material.

15. The cape according to claim 9, wherein said fasteners include one or more snaps.

16. The cape according to claim 9, wherein said vents include a plurality of apertures, a plurality of slits or a combination of said apertures and slits.

17. The cape according to claim 9, wherein said cape has a generally rectangular shape.

* * * * *